US006866551B2

(12) United States Patent
Murakami et al.

(10) Patent No.: US 6,866,551 B2
(45) Date of Patent: Mar. 15, 2005

(54) CONNECTOR TERMINAL

(75) Inventors: Takao Murakami, Shizuoka-ken (JP); Chieko Torii, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/196,164

(22) Filed: Jul. 17, 2002

(65) Prior Publication Data

US 2003/0017757 A1 Jan. 23, 2003

(30) Foreign Application Priority Data

Jul. 19, 2001 (JP) ..... 2001-220545

(51) Int. Cl.[7] ..... H01R 9/24; H01R 13/02
(52) U.S. Cl. ..... 439/884; 439/849; 439/866
(58) Field of Search ..... 439/884, 849, 439/850, 877, 866

(56) References Cited

U.S. PATENT DOCUMENTS 5,445,541 A * 8/1995 May et al. ..... 439/595
5,649,842 A 7/1997 Ohsumi
5,664,974 A * 9/1997 Endo et al. ..... 439/884
5,989,079 A * 11/1999 Seko et al. ..... 439/884
6,077,131 A * 6/2000 Fukuda et al. ..... 439/884
6,287,158 B1 * 9/2001 Brammer ..... 439/874
6,375,521 B2 * 4/2002 Tachi et al. ..... 439/884
6,402,575 B1 * 6/2002 Suzuki ..... 439/884
6,551,151 B2 * 4/2003 Suzuki ..... 439/877
2002/0111082 A1 * 8/2002 Murakami et al. ..... 439/884

FOREIGN PATENT DOCUMENTS

| | | |
|---|---|---|
| EP | 0 821 435 A3 | 1/1998 |
| EP | 0 821 435 A2 | 1/1998 |
| JP | 55-65775 | 5/1980 |
| JP | 3-39275 | 4/1991 |
| JP | 10-040986 | 2/1998 |

* cited by examiner

*Primary Examiner*—Hae Moon Hyeon
(74) *Attorney, Agent, or Firm*—Finnnegan, Henderson, Farabow, Garrett & Dunner, L.L.P.

(57) ABSTRACT

A connector terminal which includes a terminal base portion; and a tab extending from the terminal base portion to come into contact with an opponent terminal. The tab includes a bottom face portion and a folded portion extending from the bottom face portion formed by bending. The bottom face portion and the folded portion at a foot portion of the tab overlap each other to constitute at least a threefold structure.

15 Claims, 3 Drawing Sheets

CONNECTOR TERMINAL

BACKGROUND OF THE INVENTION

1. Field of the Invention

The present invention relates to connector terminals, more specifically, to a connector terminal having a tab to be inserted into an opponent terminal.

2. Description of the Related Art

A conceivable connector terminal formed by bending a metal plate of a predetermined shape includes a terminal base portion and a tab extending from the terminal base portion.

The tab is composed of a bottom face portion and a pair of folded portions formed by bending a portion extending from the bottom face portion. The folded portions substantially contact to the bottom face portion of the tab. Edges of the both folded portions abut on each other nearly in the center of the bottom face portion of the tab. An overlap of the bottom face portion of the tab and the folded portions thereof is made twofold in the entire region from a foot portion to a tip end portion of the tab. Therefore, there is a problem that strength or rigidity of the foot portion of the tab is insufficient.

SUMMARY OF THE INVENTION

The object of the present invention is to provide a connector terminal having a tab with a strong and rigid foot portion.

An aspect of the present invention is a connector terminal comprising: a terminal base portion; and a tab extending from the terminal base portion to come into contact with an opponent terminal, the tab including: a bottom face portion; and a folded portion extending from the bottom face portion formed by bending, wherein the bottom face portion and the folded portion at a foot portion of the tab overlap each other to constitute at least a threefold structure.

According to the aspect constituted as described above, the foot portion of the tab is given high geometrical moment of inertia and section modulus, thus enhancing strength and rigidity of the foot portion of the tab.

BRIEF DESCRIPTION OF THE DRAWINGS

The invention will now be described with reference to the accompanying drawings, wherein.

DETAILED DESCRIPTION OF THE PREFERRED EMBODIMENTS

Figure 1A:
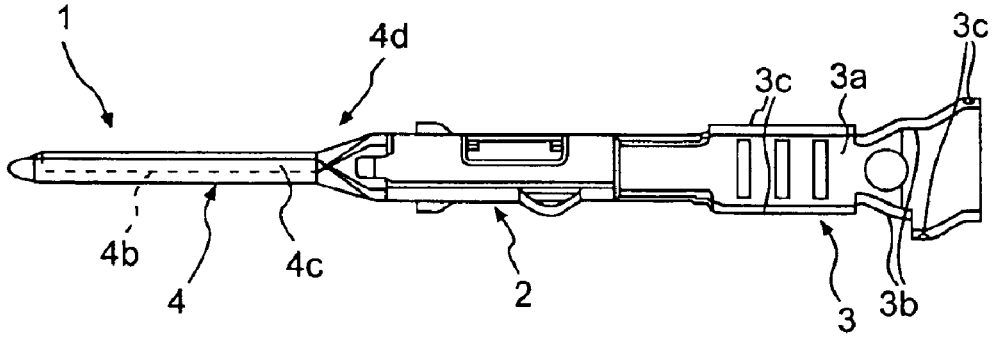
FIG. 1A is a plan view of a connector terminal according to a first embodiment of the present invention.

Embodiments of the present invention will be explained below with reference to the drawings, wherein like members are designated by like reference characters.

First Embodiment

Figure 1B:
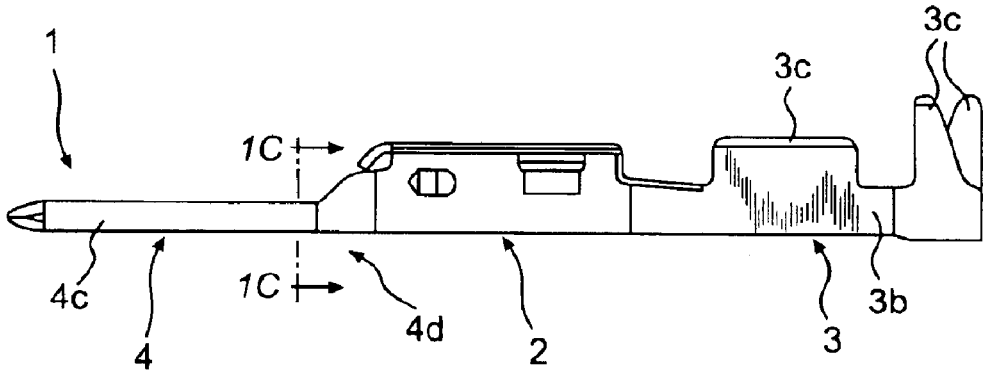
FIG. 1B is a front view of the connector terminal shown in FIG. 1A.

As shown in FIGS. 1A and 1B, a connector terminal 1 is formed by bending a metal plate of a predetermined shape. The connector terminal 1 is composed of a terminal base portion 2, an electric wire fixing portion 3 extending on a back end of the terminal base portion 2, and a tab 4 extending on a tip end of the terminal base portion 2 for contact with an opponent terminal. The electric wire fixing portion 3 includes a bottom face portion 3*a*, a pair of side plate portions 3*b* standing on the right and left sides of the bottom face portion 3*a*, and electric wire caulking portions 3*c* extending above the respective side plate portions 3*b*. Moreover, an end of an electric wire (not shown) is inserted into a space defined by the bottom face portion 3*a* and the pair of side plate portions 3*b*, and the electric wire is fastened by bending the electric wire caulking portions 3*c* so as to overlap the inserted electric wire.

Figure 1C:
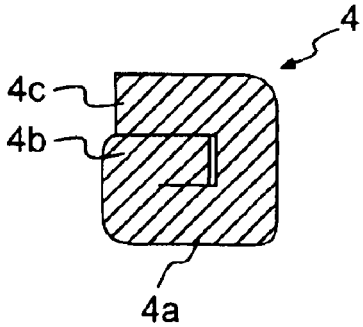
FIG. 1C is an enlarged cross-sectional view of the connector terminal shown in FIG. 1A, which is taken along the IC—IC line in FIG. 1B.

The tab 4 includes a bottom face portion (foot base portion) 4*a*, a first folded portion 4*b* formed by bending a portion extending from one of right and left sides of the bottom face portion 4*a*, and a second folded portion 4*c* formed by bending another portion extending from the other one of the right and left sides thereof. The first folded portion 4*b* is provided almost all over from a foot portion (proximal foot portion) 4*d* to a tip end portion and bent so that a lower plane thereof comes into substantial contact with the bottom face portion 4*a*. The second folded portion 4*c* is provided almost all over from the foot portion to a tip end portion and bent so that a lower plane thereof comes into substantial contact with the first folded portion 4*b*. In other words, the second folded portion 4*c* and the first folded portion 4*b* are bent in an overlapping manner. Moreover, the first and the second folded portions 4*b* and 4*c* are bent uniformly all over from the foot portions to the tip end portions in the same condition. Accordingly, as described in detail in FIG. 1C, the tab 4 is formed as threefold as a whole including the foot portion, with the bottom face portion 4*a* and the first and the second folded portions 4*b* and 4*c*.

According to the connector terminal 1, the foot portion of the tab 4 is formed as threefold consisting of the bottom face portion 4*a* and the first and the second folded portions 4*b* and 4*c*. Therefore, the foot portion of the tab 4 is given high geometrical moment of inertia and section modulus, thus enhancing strength and rigidity of the foot portion of the tab 4.

Moreover, according to the above-described first embodiment, the first and the second folded portions 4*b* and 4*c* of the tab 4 are bent uniformly all over from the foot portions to the tip end portions in the same condition. Therefore, geometrical moment of inertial and a section modulus of any portion other than the foot portion of the tab 4 are increased, thus enhancing strength and rigidity of any portion other than the foot portion of the tab 4. As a result, strength and rigidity are enhanced throughout the tab 4.

Second Embodiment

Figure 2A:
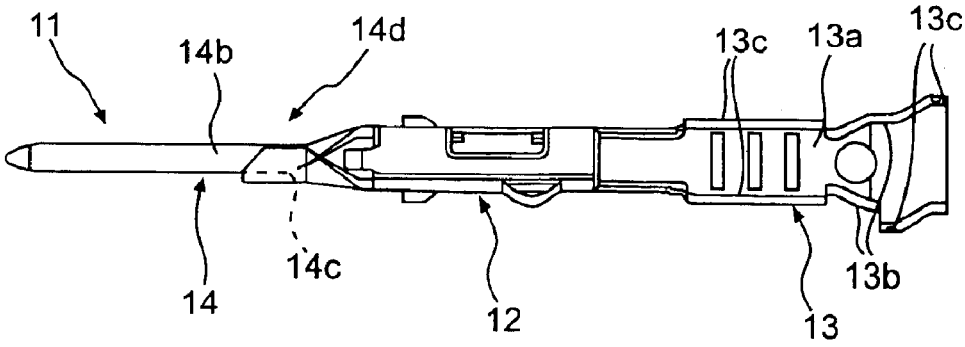
FIG. 2A is a plan view of a connector terminal according to a second embodiment of the present invention.
Figure 2B:
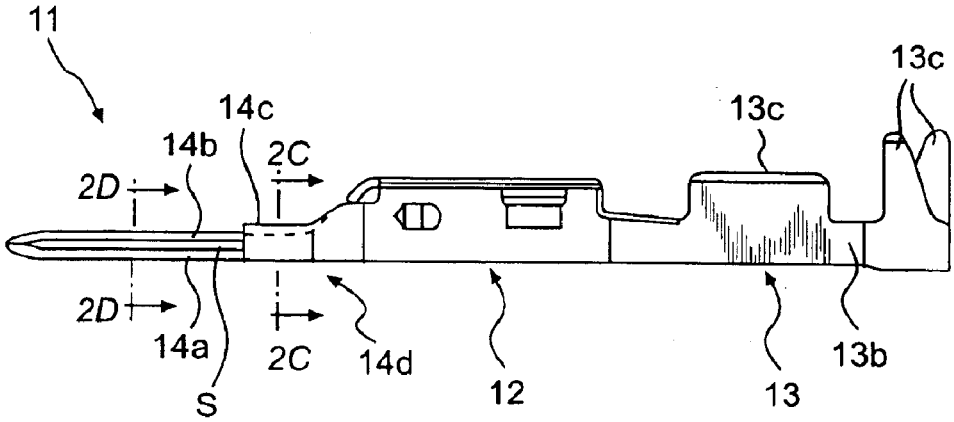
FIG. 2B is a front view of the connector terminal shown in FIG. 2A.

As shown in FIGS. 2A and 2B, a connector terminal 11 is formed by bending a metal plate of a predetermined shape. The connector terminal 11 is composed of a terminal base portion 12, an electric wire fixing portion 13 extending on a back end of the terminal base portion 12, and a tab 14 extending on a tip end of the terminal base portion 12 for contact with an opponent terminal. The electric wire fixing portion 13 includes a bottom face portion 13*a*, a pair of side plate portions 13*b* standing on the right and left sides of the bottom face portion 13*a*, and electric wire caulking portions 13*c* extending above the respective side plate portions 13*b*. Moreover, an end of an electric wire (not shown) is inserted into a space defined by the bottom face portion 13*a* and the pair of side plate portions 13*b*, and the electric wire is fastened by bending the electric wire caulking portions 13*c* so as to overlap the inserted electric wire.

Figure 2C:
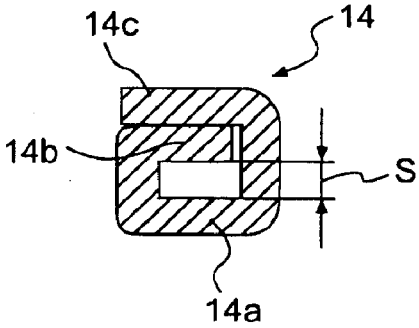
FIG. 2C is an enlarged cross-sectional view of the connector terminal shown in FIG. 2A, which is taken along the IIC—IIC line in FIG. 2B.
Figure 2D:
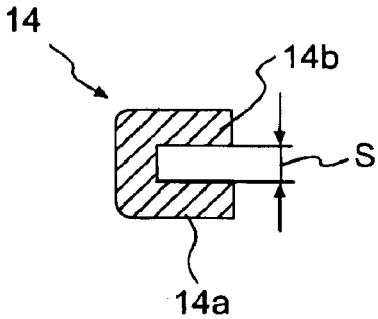
FIG. 2D is an enlarged cross-sectional view of the connector terminal shown in FIG. 2A, which is taken along the IID—IID line in FIG. 2B.

The tab 14 includes a bottom face portion (foot base portion) 14*a*, a first folded portion 14*b* formed by bending a portion extending from one of right and left sides of the bottom face portion 14*a*, and a second folded portion 14*c* formed by bending another portion extending from the other one of the right and left sides thereof. The first folded portion 14*b* is provided all over from a foot portion (proximal foot portion) 14*d* to a tip end portion and bent such that a lower plane thereof overlaps the bottom face portion 14*a* with provision of a space S as shown in FIG. 2D. The second folded portion 14*c* is provided only on the foot portion and bent such that a lower plane thereof comes into substantial contact with the first folded portion 14*b* as shown in FIG. 2C. In other words, the second folded portion 14*c* and the first folded portion 14*b* are disposed with provision of the space S against the bottom face portion 14*a* and bent in an overlapping manner. Accordingly, the foot portion of the tab 14 is formed as threefold consisting of the bottom face portion 14*a* and the first and the second folded portions 14*b* and 14*c*, and the portion other than the foot portion of the tab 14 is formed as twofold consisting of the bottom face portion 14*a* and the first folded portion 14*b*, respectively.

According to the connector terminal 11, the foot portion of the tab 14 is formed as threefold consisting of the bottom face portion 14*a* and the first and the second folded portions 14*b* and 14*c*. Therefore, the foot portion of the tab 14 is given high geometrical moment of inertia and section modulus, thus enhancing strength and rigidity of the foot portion of the tab 14.

Moreover, according to the above-described second embodiment, the first and the second folded portions 14*b* and 14*c* of the foot portion of the tab 14 are bent so as to overlap each other with provision of the space S against the bottom face portion 14*a*. Therefore, the foot portion of the tab 14 shows geometrical moment of inertia and a section modulus which are higher than those in the case of overlapping the bottom face portion 14*a*, and the first and the second folded portions 14*b* and 14*c* in substantially contacting manner (the first embodiment). Hence, strength and rigidity of the foot portion of the tab 14 are further enhanced.

Moreover, according to the second embodiment, the first folded portion 14*b* of the portion other than the foot portion of the tab 14 is bent so as to overlap the bottom face portion 14*a* with provision of the space S. Therefore, the portion other than the foot portion of the tab 14 also shows geometrical moment of inertia and a section modulus which are higher than those in the case of overlapping the bottom face portion 14*a*, and the first and the second folded portions 14*b* and 14*c* in a substantially contacting manner (the first embodiment). Hence, strength and rigidity of any portion other than the foot portion of the tab 14 are also enhanced. As a result, strength and rigidity are enhanced throughout the tab 14.

Third Embodiment

Figure 3A:
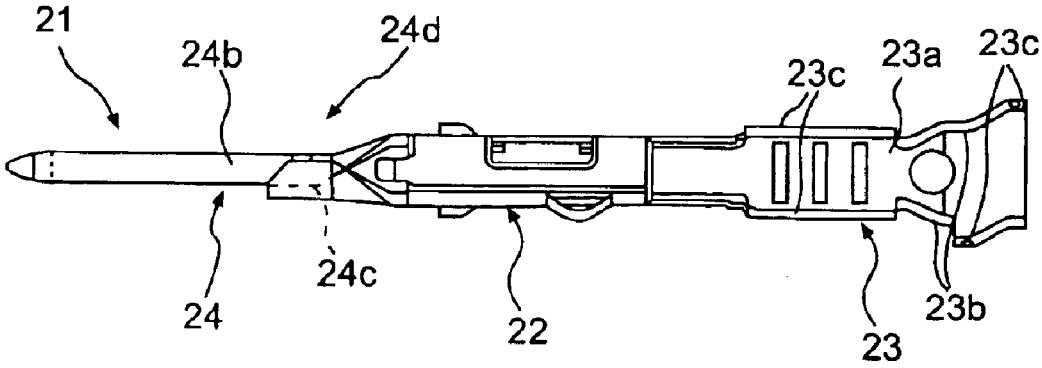
FIG. 3A is a plan view of a connector terminal according to a third embodiment of the present invention.
Figure 3B:
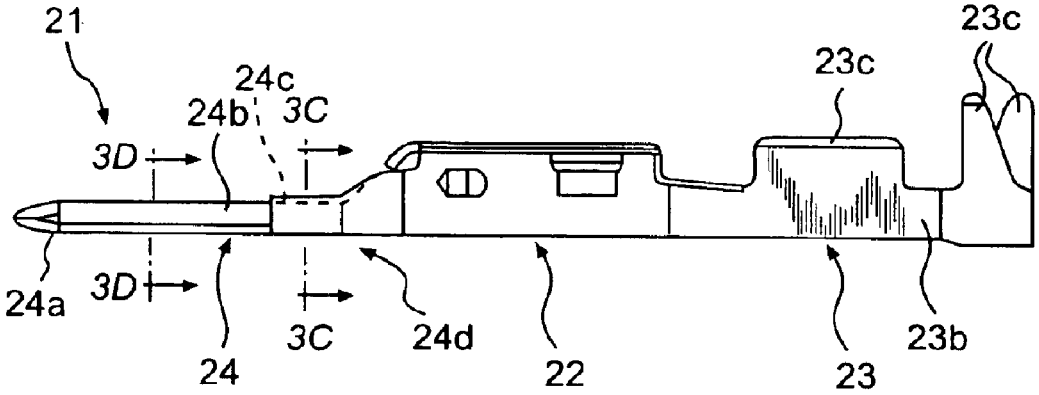
FIG. 3B is a front view of the connector terminal shown in FIG. 3A.

As shown in FIGS. 3A and 3B, a connector terminal 21 is formed by bending a metal plate of a predetermined shape. The connector terminal 21 is composed of a terminal base portion 22, an electric wire fixing portion 23 extending on a back end of the terminal base portion 22, and a tab 24 extending on a tip end of the terminal base portion 22 for contact with an opponent terminal. The electric wire fixing portion 23 includes a bottom face portion 23*a*, a pair of side plate portions 23*b* standing on the right and left sides of the bottom face portion 23*a*, and electric wire caulking portions 23*c* extending above the respective side plate portions 23*b*. Moreover, an end of an electric wire (not shown) is inserted into a space defined by the bottom face portion 23*a* and the pair of side plate portions 23*b*, and the electric wire is fastened by bending the electric wire caulking portions 23*c* so as to overlap the inserted electric wire.

Figure 3C:
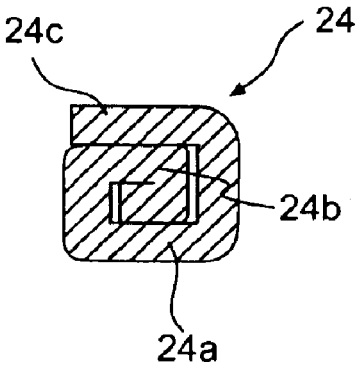
FIG. 3C is an enlarged cross-sectional view of the connector terminal shown in FIG. 3A, which is taken along the IIIC—IIIC line in FIG. 3B.
Figure 3D:
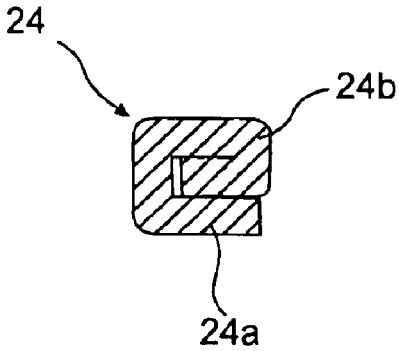
FIG. 3D is an enlarged cross-sectional view of the connector terminal shown in FIG. 3A, which is taken along the IIID—IIID line in FIG. 3B.

The tab 24 includes a bottom face portion (foot base portion) 24*a*, a first folded portion 24*b* formed by bending a portion extending from one of right and left sides of the bottom face portion 24*a*, and a second folded portion 24*c* formed by bending another portion extending from the other one of the right and left sides thereof. The first folded portion 24*b* is provided all over from a foot portion (proximal foot portion) 24*d* to a tip end portion. Further, as shown in FIG. 3D, the first folded portion 24*b* is bent in a doubly overlapping manner with respect to the bottom face portion 24*a*, and a lower plane of the doubly overlapping structure comes into substantial contact with the bottom face portion 24*a*. The second folded portion 24*c* is provided only on the foot portion and bent so that a lower plane thereof comes into substantial contact with the first folded portion 24*b* as shown in FIG. 3C. Accordingly, the foot portion of the tab 24 is formed as fourfold consisting of the bottom face portion 24*a* and the first and the second folded portions 24*b* and 24*c*, and the portion other than the foot portion of the tab 24 is formed as threefold consisting of the bottom face portion 24*a* and the first folded portion 24*b*, respectively.

According to the connector terminal 21, the foot portion of the tab 24 is formed as fourfold consisting of the bottom face portion 24*a* and the first and the second folded portions 24*b* and 24*c*. Therefore, the foot portion of the tab 24 is given high geometrical moment of inertia and section modulus, thus enhancing strength and rigidity of the foot portion of the tab 24.

Moreover, in the above-described third embodiment, the overlap of the tab 24 in the portion other than the foot portion is made threefold. Therefore, the portion other than the foot portion of the tab 24 shows geometrical moment of inertia and a section modulus which are higher than those in the case of forming the bottom face portion 24*a* and the first folded portion 24*b* in the portion other than the foot portion of the tab 24 into a twofold structure. Hence, strength and rigidity of the portion other than the foot portion of the tab 24 are further enhanced as well.

In the respective embodiments described above, the threefold structure or the fourfold structure has been formed by providing the first and the second folded portions 4*b*, 4*c*, 14*b*, 14*c*, 24*b* and 24*c* extending from the both right and left sides of the bottom face portions 4*a*, 14*a* and 24*a*, and by bending these folded portions accordingly. However, the threefold or the fourfold structure may be also formed by providing a single folded portion extending from either the right or the left end of the bottom face portions 4*a*, 14*a* and 24*a* and by bending the folded portion accordingly. Nevertheless, it is preferred to provide the first and the second folded portions 4*b*, 4*c*, 14*b*, 14*c*, 24*b* and 24*c* extending from the both right and left sides of the bottom face portions 4*a*, 14*a* and 24*a*, and to bend these folded portions accordingly to form threefold or greater overlapping structures, because bending operations are easier, and strength and rigidity can be enhanced.

In the respective embodiments described above, although the first and the second folded portions 4*b*, 4*c*, 14*b*, 14*c*, 24*b* and 24*c* are formed by bending so as to form the foot portions of the tabs 4, 14 and 24 into the threefold or the fourfold structure, it is also possible to form the foot portion by bending so as to constitute a fivefold structure or greater. In such a case, if a tab includes a structure with a greater number of overlaps, strength and rigidity of such a tab will be enhanced further.

Although only three embodiments of the invention have been disclosed and described, it is apparent that the other embodiments and modification of the invention are possible.

What is claimed is:

1. A connector terminal comprising:

an electric wirefixing portion;

a terminal base portion located distal of the electric wire fixing portion; and a tab portion located distal of the terminal base portion and having a tapered proximal foot portion adjoining the terminal base portion and a distal tip portion, the tapered proximal foot portion having a foot base portion, a first folded portion and a second folded portion extending from the foot base portion, the first and second folded portions bent towards each other so that the tapered proximal foot portion includes a generally closed four-sided structure having at least three layers, wherein the first folded portion overlaps and contacts the foot base portion.

2. The connector terminal of claim 1, wherein the second folded portion overlaps and contacts the first folded portion.

3. The connector terminal of claim 1, wherein the tapered proximal foot portion includes an internal space separating one of the at least three layers from another of the at least three layers.

4. The connector terminal of claim 1, wherein the wire fixing portion comprises a wire fixing base portion, at least one side portion, and a caulking portion extending from the at least one side portion.

5. The connector terminal of claim 1, wherein the first folded portion overlaps and contacts the foot base portion.

6. A connector terminal comprising:

an electric wirefixing portion;

a terminal base portion located distal of the electric wire fixing portion; and a tab portion located distal of the terminal base portion and having a tapered proximal foot portion adjoining the terminal base portion and a distal tip portion, the tapered proximal foot portion having a foot base portion, a first folded portion and a second folded portion extending from the foot base portion, the first and second folded portions bent towards each other so that the tapered proximal foot portion includes at least three layers, wherein the at least three layers are in overlapping contact.

7. A connector terminal comprising:

an electric wirefixing portion;

a terminal base portion located distal of the electric wire fixing portion; and a tab portion located distal of the terminal base portion and having a tapered proximal foot portion adjoining the terminal base portion and a distal tip portion, the tapered proximal foot portion having a foot base portion, a first folded portion and a second folded portion extending from the foot base portion, the first and second folded portions bent towards each other, and the first folded portion disposed between the foot base portion and the second folded portion, wherein the tapered proximal foot portion includes a four-layered structure and the first folded portion forms two levers of the four-layered structure.

8. A connector terminal comprising:

an electric wirefixing portion;

a terminal base portion located distal of the electric wirefixing portion; and a tab portion located distal of the terminal base portion and having a tapered proximal foot portion adjoining the terminal base portion and a distal tip portion, the tab portion from the tip portion to the tapered proximal foot portion having at least three layers, wherein the at least three layers comprise a tab base portion and a first and second folded portion each extending from the tab base portion.

9. The connector terminal of claim 8, wherein the second folded portion overlaps and contacts the first folded portion.

10. The connector terminal of claim 8, wherein the first folded portion overlaps and contacts the tab base portion.

11. The connector terminal of claim 8, wherein the at least three layers are in overlapping contact.

12. The connector terminal as in claim 8, wherein the wire fixing portion comprises a wire fixing base portion, at least one side portion, and a caulking portion extending from the at least one side portion.

13. A connector terminal comprising:

an electric wire fixing portion;

a terminal base portion located distal of the electric wire fixing portion; and a tab portion located distal of the terminal base portion and having a tapered proximal foot portion adjoining the terminal base portion and a distal tip portion, the tapered proximal foot portion having a foot base portion, a first folded portion and a second folded portion extending from the foot base portion, the first and second folded portions bent towards each other so that the tapered proximal foot portion includes a structure having at least three layers, and the tab portion between the tapered proximal foot portion and the distal tip portion having a base portion and a folded portion bent to form a generally open three-sided structure.

14. The connector terminal of claim 13, wherein the first folded portion overlaps the foot base portion.

15. The connector terminal of claim 14, wherein the second folded portion overlaps the first folded portion.

* * * * *

UNITED STATES PATENT AND TRADEMARK OFFICE

CERTIFICATE OF CORRECTION

PATENT NO. : 6,866,551 B2
DATED : March 15, 2005
INVENTOR(S) : Takao Murakami and Chieko Torii It is certified that error appears in the above-identified patent and that said Letters Patent is hereby corrected as shown below:

Column 5,
Lines 31 and 58, “wirefixing” should read -- wire fixing --.

Column 6,
Lines 6, 23 and 25, “wirefixing” should read -- wire fixing --.
Line 20, “levers” should read -- layers --.

Signed and Sealed this

Fifth Day of July, 2005

JON W. DUDAS
*Director of the United States Patent and Trademark Office*